US005992061A

United States Patent [19]

Fleck et al.

[11] Patent Number: 5,992,061

[45] Date of Patent: Nov. 30, 1999

[54] DRAGLINE BUCKET DUMP COMPENSATOR

[75] Inventors: Robert S. Fleck, Portland; Charles G. Ollinger, IV, Aloha, both of Oreg.

[73] Assignee: Esco Corporation, Portland, Oreg.

[21] Appl. No.: 08/900,351

[22] Filed: Jul. 25, 1997

[51] Int. Cl.[6] ..... E02F 3/58

[52] U.S. Cl. ..... 37/397; 37/401; 37/399

[58] Field of Search ..... 37/394, 395, 396, 37/397, 399, 401

[56] References Cited

U.S. PATENT DOCUMENTS

| | | | |
|---|---|---|---|
| 2,168,643 | 8/1939 | Berner . | |
| 3,247,607 | 4/1966 | Page . | |
| 3,597,865 | 8/1971 | Rumfelt . | |
| 4,791,738 | 12/1988 | Briscoe . | |
| 4,864,747 | 9/1989 | Martin et al. . | |
| 5,428,909 | 7/1995 | Immel | 37/399 |
| 5,636,460 | 6/1997 | Drezka | 37/397 |

*Primary Examiner*—H. Shackelford
*Attorney, Agent, or Firm*—Banner & Witcoff, Ltd.

[57] ABSTRACT

A hoisting assembly for use with a dragline bucket that includes a compensator for generally stabilizing the attitude of the bucket. The compensator is operably coupled to the lift, hoist and dump lines. The connector for the lift line(s) defines a fulcrum about which the compensator turns during use. As the tension in the dump line increases relative to the tension of the hoist lines, the compensator turns about the fulcrum to lift the hoist lines and shift the sheave supporting the dump line forward. As the tension in the dump line decreases relative to the tension of the hoist lines, the compensator turns about the fulcrum in the opposite direction to lower the lift lines and shift the sheave supporting the dump line rearward.

33 Claims, 8 Drawing Sheets

DRAGLINE BUCKET DUMP COMPENSATOR

The present invention is directed to a dragline bucket assembly, and, more particularly, to a dragline bucket dump compensator which provides dynamic adjustment of the carrying attitude of the bucket due to relative changes in the tension of the dump and hoist lines.

BACKGROUND OF THE INVENTION

A dragline bucket is a shovel-like enclosure which is advanced and controlled by flaccid lines, such as chains, cables or ropes. The bucket includes an open end through which earthen material is received and accumulated in the bucket as it is dragged through the ground.

A typical bucket of the prior art is supported in part by a pair of hoist lines which are attached to opposite side walls of the bucket. The hoist lines are, in turn, coupled through a linkage assembly to one or more lift lines which extend down from an overhead boom. A dump line is connected to the front end of the bucket and to a drag line (commonly referred to as a drag rope) used for pulling the bucket through the ground. A medial portion of the dump line is wrapped about the sheave of a dump block which is also connected through a linkage assembly to the lift lines. The tension applied to the dump line by the drag line causes the dump line to raise the front of the bucket. Release of the tension then permits the front of the bucket to tip forward and dump the accumulated load.

In the prior art, the attitude of the dragline bucket varies greatly depending upon the tension in the dump line. The dump line tension varies not only because of changes in the tension of the drag line, but also on account of its orientation relative to the drag line. For example, a greater share of the tension in the drag line is transmitted to the dump line as the forward portion of the dump line (i.e., the portion extending between the drag line and the dump block) approaches an aligned relationship with the drag line, such as in a tightline position near the boom. In this case, the front of the bucket is pulled upward to form a significant rearward cant in the bucket's attitude. However, if the forward portion of the dump line is set at a smaller angle to the drag line, such as in a lower pit position below the distal end of the boom, then less tension is applied to the dump line. As a result, the bucket tips forward and risks spilling part of the accumulated load through the open front end.

U.S. Pat. No. 3,597,865 to Rumfelt discloses a dragline bucket assembly with a device which seeks to maintain the bucket in a proper carrying attitude. The device of Rumfelt comprises a cylindrical member connected to lift lines and a rod movable in the cylindrical member connected to hoist lines. The rod is biased within the cylinder by a spring assembly including a coil spring, an abutment, nuts, and a closure plug. A dump sheave for supporting a dump rope is connected to the exterior of the cylindrical member. In operation, the rod moves outwardly against the spring tension as the bucket is loaded, and thereby increases the distance between the sheave and the bucket. This outward adjustment of the rod increases the moment arm between the bucket and the dump line, and thus reduces the tension needed in the dump line to support the front of the bucket.

However, the use of such a spring is not considered feasible for the loads and stresses involved in a modern dragline operation. For example, loads in the lift lines for large dragline buckets can reach 500,000 pounds or more. Further, the movements associated with the adjustment of the spring in this device are not deemed likely to significantly alter the position of the dump line and produce the desired level of stabilization. Moreover, the device of Rumfelt is complex and susceptible to fatigue and performance degradation over time as the coil spring wears out.

In the prior art, different lengths of dump lines have also been used in an effort to accommodate different working conditions for a dragline bucket. For instance, short lengths of dump line have been used when a bucket is deployed deep in the pit, and long lengths of dump line have been used when the bucket operates close to the boom. However, these arrangements place restraints on the operation of the bucket and increase the bucket's down time to replace the dump lines as needed.

SUMMARY OF THE INVENTION

The present invention pertains to a compensator for use in a dragline bucket hoisting assembly. The compensator is effective in stabilizing the bucket's attitude during various positions. Accordingly, the compensator allows fuller loads to be picked up by the bucket and less spillage to occur during movement of the bucket. Further, the compensator of the present invention has a rigid, efficient construction which is reliable and durable even under heavy loading.

The compensator of the present invention is operably coupled to the lift, hoist and dump lines. The connector coupling the lift line(s) to the compensator defines a fulcrum with a transverse axis about which the compensator turns due to variations in the relative tension between the dump line and the hoist lines. As the tension in the dump line increases relative to the tension in the hoist lines, the compensator turns so as to lift the hoist chains and shift the sheave supporting the dump line forward relative to the fulcrum.

In accordance with one aspect of the invention, the dump and hoist lines are connected to the compensator on opposite sides of the connection of the lift line(s). In a preferred construction, the connections are not aligned, such that an imaginary line extending between the connector for the lift line(s) and the connector for the sheave supporting the dump line is set at a significant angle to an imaginary line extending between the connector for the lift line(s) and the connector for the hoist lines. Further, these connectors are arranged on the compensator such that an increase in the tension of the dump line relative to the tension of the hoist lines causes the compensator to turn about the defined fulcrum and thereby lift the hoist lines and shift the sheave forward.

In accordance with a second aspect of the invention, the hoist lines and the sheave for the dump line are operably connected to each other by a coupling line which extends over a generally arcuate exterior of the compensator. The compensator is coupled to the lift line(s) by a connector which defines an off-center fulcrum about which the compensator turns on account of relative changes in the tension of the dump line and the hoist lines. The turning of the compensator adjusts the coupling line and thereby effects the desired shifting of the sheave and hoist lines.

BRIEF DESCRIPTION OF THE DRAWINGS

Certain preferred embodiments are described in detail below with reference to the appended drawings wherein.

Figure 1:
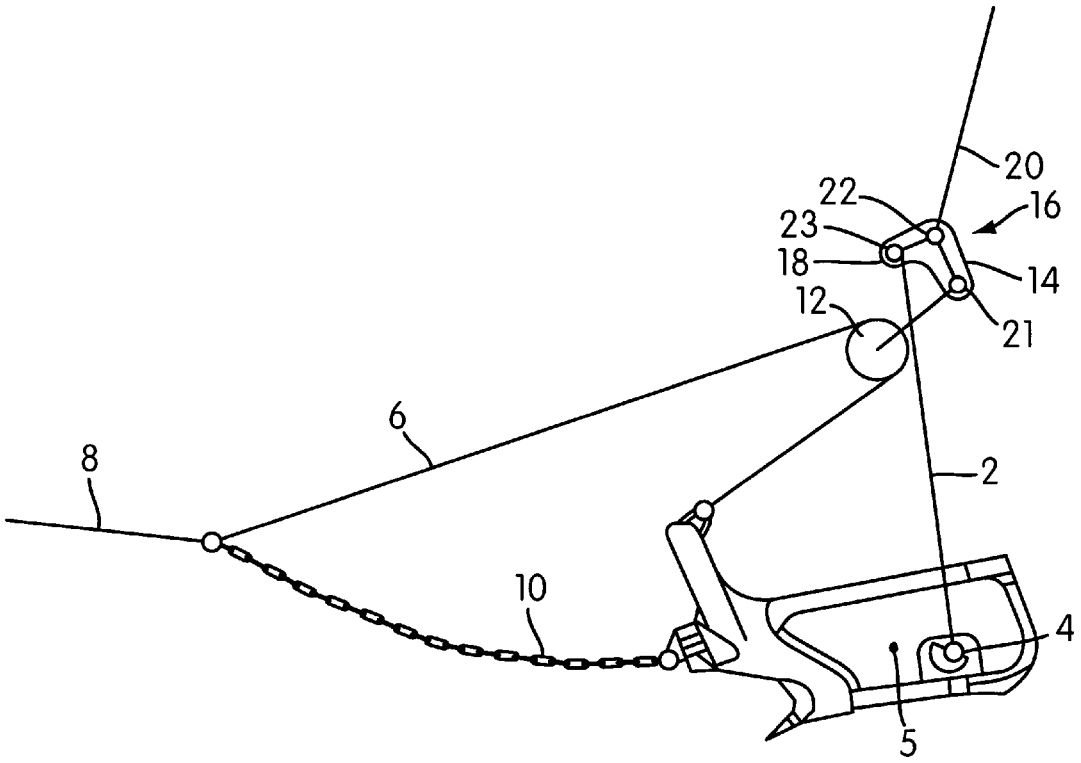
FIG. 1 is a schematic elevation view of a dragline bucket assembly with the dragline compensator of the present invention shown in simplified form.

The figures referred to above are not drawn necessarily to scale and should be understood to present a simplified representation of the invention, illustrative of the basic principles involved. The same reference numbers are used in the drawings for similar or identical components and features shown in various alternative embodiments. Dragline dump compensators as disclosed above, will have configurations and components determined, in part, by the intended application and environment in which they are used.

DETAILED DESCRIPTION OF THE PREFERRED EMBODIMENTS

In a preferred construction of the present invention, hoist lines 2 are attached to opposed sides of a dragline bucket 4, typically at a point rearward of the center of gravity 5 of the bucket (FIG. 1). The hoist lines are coupled through a compensator 16 and other conventional linkage equipment (FIGS. 2 and 3) to one or more lift lines 20 which extend down from a boom (not shown). A drag line 8 (typically referred to as a drag rope) is attached to the front of the bucket via pull lines 10 (typically referred to as drag chains) in order to pull the bucket through the ground. A dump line 6 is attached to the drag line 8 and the front of the bucket 4. A medial portion of the dump line is supported by a dump block 12 attached to the compensator. As a result, the dump line 6 via dump block 12, lift lines 20 and hoist lines 2 are all operably coupled to compensator 16 which functions to maintain the bucket in a substantially constant attitude.

In a typical operation, tension in drag line 8 is created by a dragline machine (not shown) which, through pull lines 10, pulls bucket 4 through the ground to accumulate a load of earthen material in the bucket. When a desired amount of material is accumulated in the bucket, lift lines 20 connected to a boom are raised to thereby lift the bucket. Tension in dump line 6 raises the forward upper edge of bucket 4 to prevent unintended spillage of the material collected in the bucket. To empty the bucket, the tension in drag line 8, and thus, the tension in dump line 6 is released, which allows bucket 4 to tip forward and spill its contents.

The compensator 16 is a rigid member which is operably coupled to the lift, dump, and hoist lines of the hoisting assembly for a dragline bucket. More specifically, dump line 6 (via dump block 12) is coupled to compensator 16 at a connection point 21. The one or more lift lines 20 are connected to the compensator at a connection point 22, which as discussed below defines a fulcrum. Hoist lines 2 are connected to the compensator at a connection point 23. The connection points 21–23 are preferably in a non-aligned relationship, although they could in certain circumstances be aligned. For example, the fulcrum 22 could be positioned in between the other two connection points in a linearly aligned relationship. Other arrangements of the connection points could also be had so long as the sheave and hoist lines are properly adjusted to stabilize the attitude of the bucket in response to variations in the relative tensions of the dump and hoist lines.

In the preferred construction, compensator 16 has a pair of angularly oriented legs 14, 18 which are interconnected at a common end. While the legs 14, 18 are preferably oriented at angle of about 90°, other angular relationships could be used. The legs can have the same or different lengths to meet the needs of different operations. Moreover, the actual shape of the compensator itself is largely irrelevant. For example, the compensator could be triangular, circular, irregular or another shape so long as the points of connection 21–23 coupling the hoist, lift and dump lines to the compensator are arranged to achieve the desired shifting as discussed more fully below.

Figure 8:
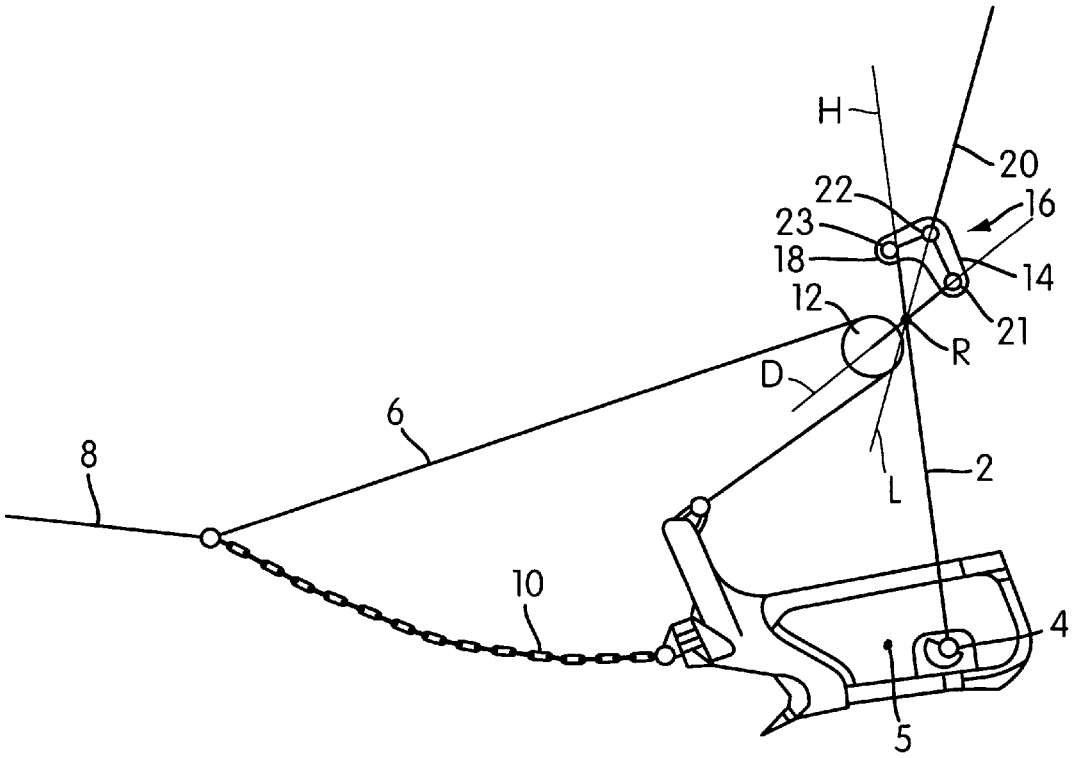
FIG. 8 is identical to FIG. 1 and includes reference vectors and an intersecting reference point.

Another way to understand the action of the compensated hoisting assembly is by describing the movements of the components with reference to structural reference points. The lines of action of the force vectors are shown in FIG. 8 in which hoist line vector H intersects with lift line vector L and a dump line vector D, a resultant of the dump line portions through the center of the sheave, intersect at a reference point R. Reference point R is a convenient reference point to use in describing the relative movements of the components. When tension on the dump line is high relative to the tension in the hoist line, the sheave will move forward with respect to reference point R to minimize the extent that the bucket front is raised which in effect raises the bucket rear. Conversely, when the tension on the dump line is low, the sheave will move rearward relative to reference point R to minimize the extent that the bucket front is lowered. The bucket front will appear to raise. The compensator rotates to achieve these sheave movements to maintain a relatively constant attitude of the bucket through all positions in the range.

Figure 2:
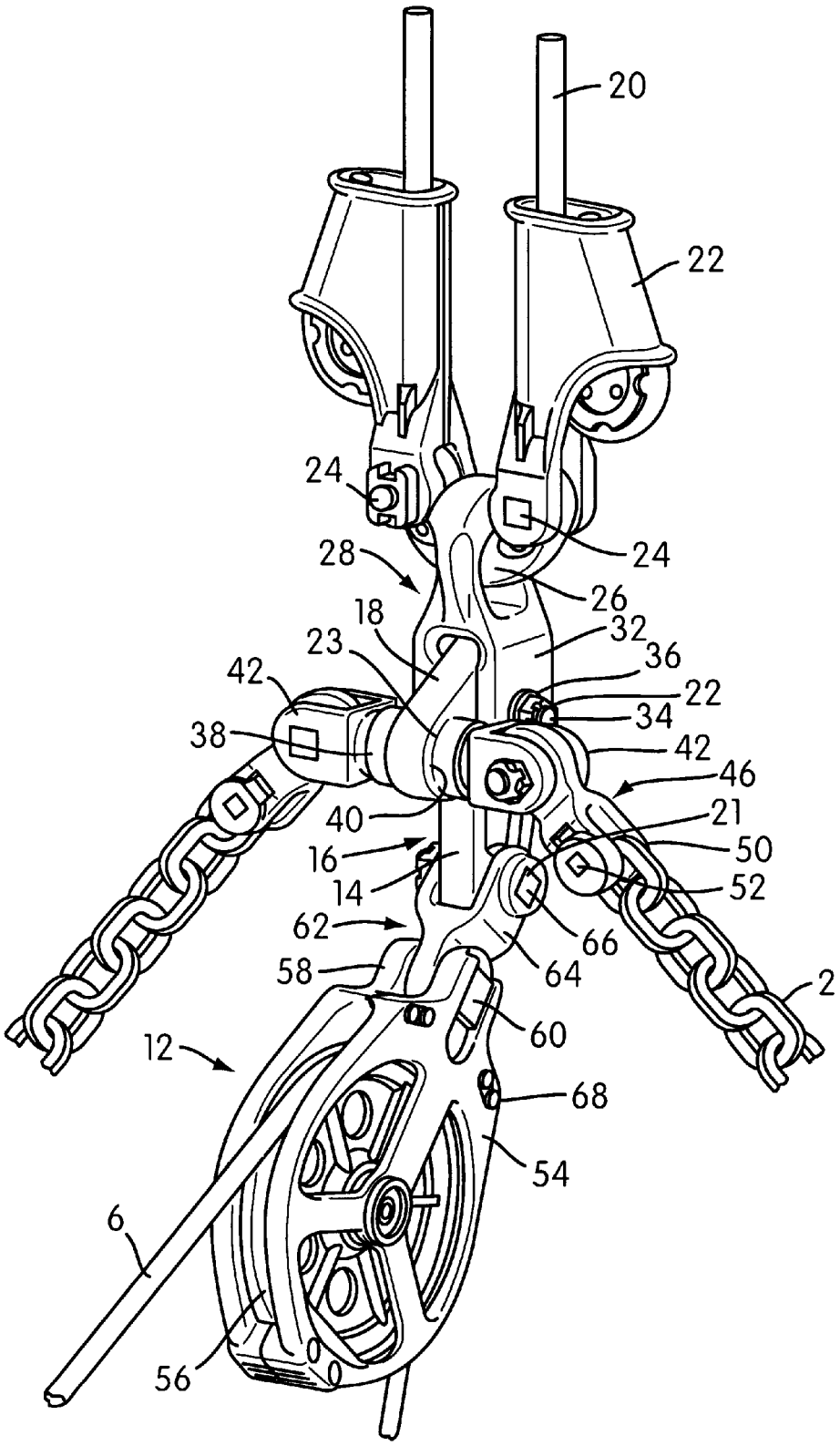
FIG. 2 is a perspective view of the dragline compensator, shown connected to lift lines, hoist lines, and a dump line.
Figure 3:
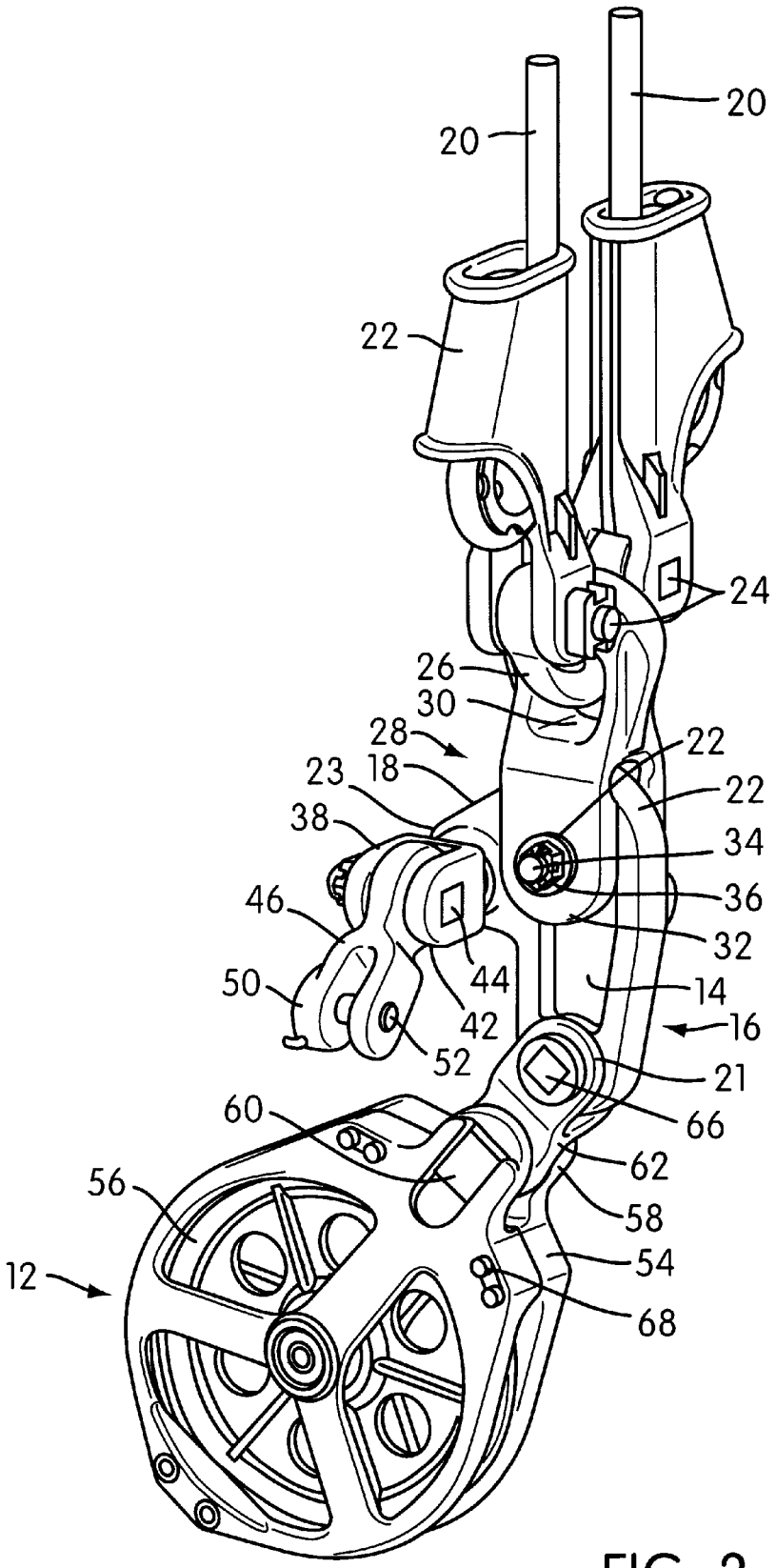
FIG. 3 is perspective view of the dragline compensator of FIG. 2 shown without the hoist and dump lines.

Turning now to FIGS. 2 and 3, a preferred hoisting assembly for lifting and controlling a dragline bucket 4 will be described in greater detail. The lift lines 20 extending down from a boom (not shown) are secured in a known manner to hoist sockets 22 which, in turn, are pivotally attached to an equalizer 26. The equalizer is pivotally secured to link 28 in order to compensate for differences which may exist in the lengths of the two lift lines 20. Equalizer 26 is preferably a substantially U-shaped member connected at each free end to a corresponding hoist socket 22 by a fastener 24, but could of course have other shapes. Fasteners 24 may be pins with collars as shown, nuts and bolts, or any other suitable fastener. In the illustrated construction, the equalizer passes through an aperture 30 formed in link 28 which acts as a fulcrum about which equalizer 26 pivots to substantially equalize the tension in lift lines 20. Nevertheless, other equalizer constructions could be used. A clevis 32 or other connector is formed on a lower end of link member 28 to effect the pivotal connection with compensator 16 at connection point 22. Connection point 22 is at the common end of legs 14, 18 and between connection points 21, 23 for the hoist and dump lines. A fastener 34 extends through the clevis 32 and an aperture formed in compensator 16 to define a fulcrum about which the compensator turns. While two lift lines 20 are used in the present example, other numbers of lift lines (e.g., one or four) could be used with a corresponding change in the linkage).

Hoist lines 2 extend up from the bucket to connect to leg 18 of compensator 16. In particular, a hoist link member 38 is received through an aperture 40 formed at connection point 23 proximate the free end of second leg 18 of compensator 16 to effect attachment of the hoist lines 2. The hoist link member is preferably a generally linear member pivotally received through aperture 40 in order to accommodate movement of the hoist lines 2 during use. A clevis 42 or other connector is formed on each end of the hoist link member 38 to effect a connection with hoist swivel links 46 secured to hoist lines 2. In the preferred construction, each hoist swivel link 46 also includes a clevis 50 or other connector which attaches to hoist lines 2.

Dump block 12 comprises a sheave 56 that rotates about a central pin to movably support a dump line 6, and a housing 54 which encases the sheave and couples the sheave to the compensator. In the preferred construction, dump block 12 is pivotally attached to leg 14 of compensator 16 by a sheave link member 62. A clevis 58 or other connector formed on an upper end of housing 54 is pivotally secured to a tab of the sheave link member 62 via a fastener 60. A clevis 64 or other connector is formed on an opposite end of sheave link member 62 to effect pivotal connection to leg 14 via fastener 66. Nonetheless, other linkage connections could be used. Alternatively, the sheave could be pinned directly to the compensator. In this embodiment, leg 14 would preferably be bifurcated to accommodate the sheave.

As can be appreciated, numerous changes can be made in the linkages to facilitate use in a wide variety of dragline operations. For example, the specific type of connections, the number and type of parts, and the number of lift lines and dump lines can all be varied without affecting the operation of the present invention. In the case of using two dump lines, a compensator could be provided for each dump line, or alternatively, a single compensator could be coupled to both dump lines via an equalizer.

Figure 4A:
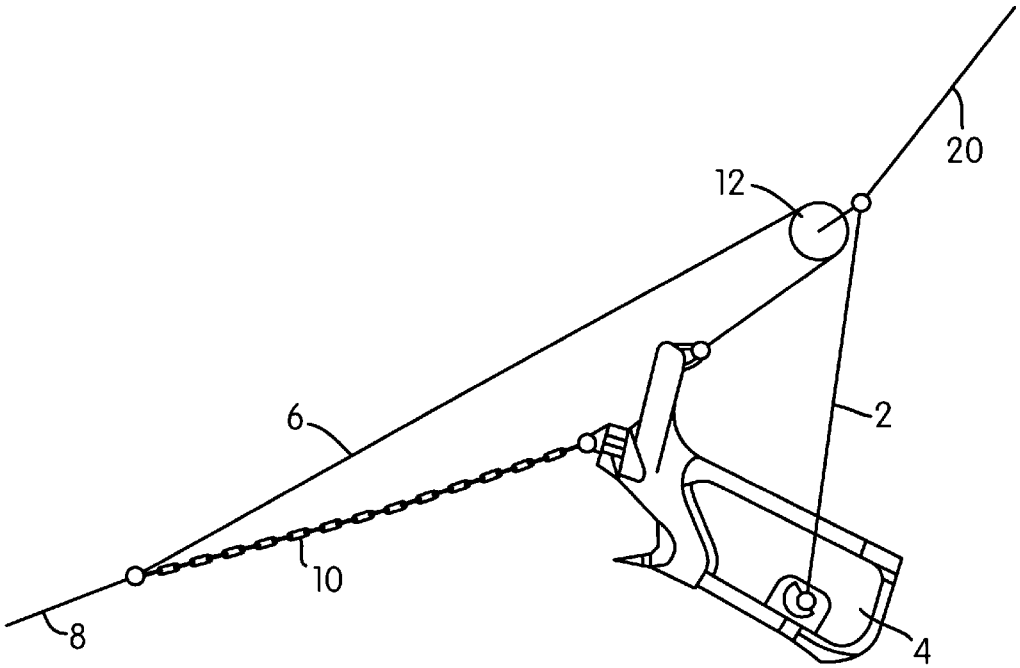
FIG. 4A PRIOR ART
FIG. 4A is a schematic elevational view of a prior art dragline bucket assembly in an operating position near the boom.
Figure 4B:
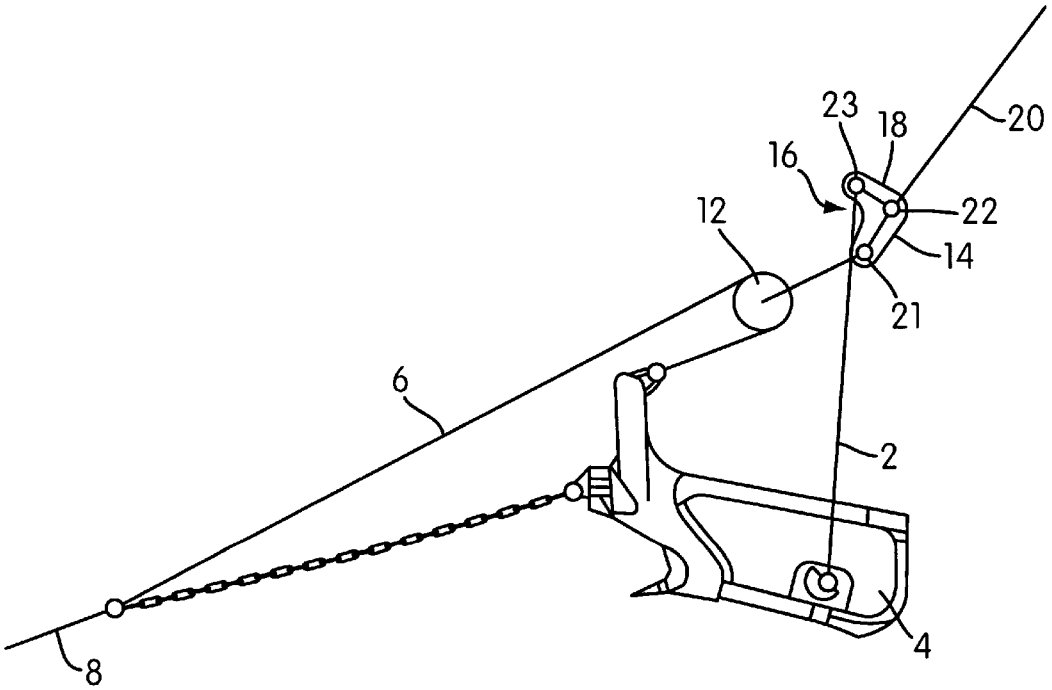
FIG. 4B is a schematic elevational view of a dragline bucket assembly with a compensator in accordance with the present invention in an operating position near the boom.

FIGS. 4A and 4B depict an operating condition approaching a tightline condition, that is, for example, a condition where bucket 4 is close to the boom. FIG. 4A depicts this condition without the compensator of the present invention. In a tightline condition, the angle between drag line 8 and lift lines 20 is relatively large, and approaches 180° as the bucket nears the boom. At this point, the forward portion of the dump line (i.e., the portion extending between drag line 8 and dump block 12) is nearly aligned with drag line 8, and therefore assumes a large portion of the tension created in the drag line 8. As a result, the tension in dump line 6 is large and pulls upwardly on the forward upper edge of bucket and increases the rearward carrying attitude, or angle, of bucket 4 with respect to the ground.

FIG. 4B depicts this same tightline condition with a compensator 16 of the present invention incorporated into the hoisting assembly. The tension in dump line 6 as the bucket is moved to this condition typically increases relative to the tension in hoist lines 2 (i.e., the tension in dump line 6 increases at a greater percentage than the increase in the hoist lines). As a result, the compensator 16 rotates about fulcrum 22 such that hoist lines 2 are lifted and sheave 56 is shifted forward relative to the fulcrum. In this way, the increased upward pulling of the dump line on the front of the bucket caused by greater tension in the dump line is largely offset by raising the rear of the bucket via hoist lines 2 and shifting the sheave 56 of dump block 12 forward to lower the front of the bucket. Accordingly, while some amount of variation still occurs, the range of attitude changes of the bucket is substantially reduced as compared to the prior art. For most operations, the bucket is preferably maintained at a generally level attitude with a slight rearward cant as shown in FIG. 4B. Nevertheless, the compensator can be used to substantially maintain different attitudes of the bucket to suit each digging operation.

Figure 9:
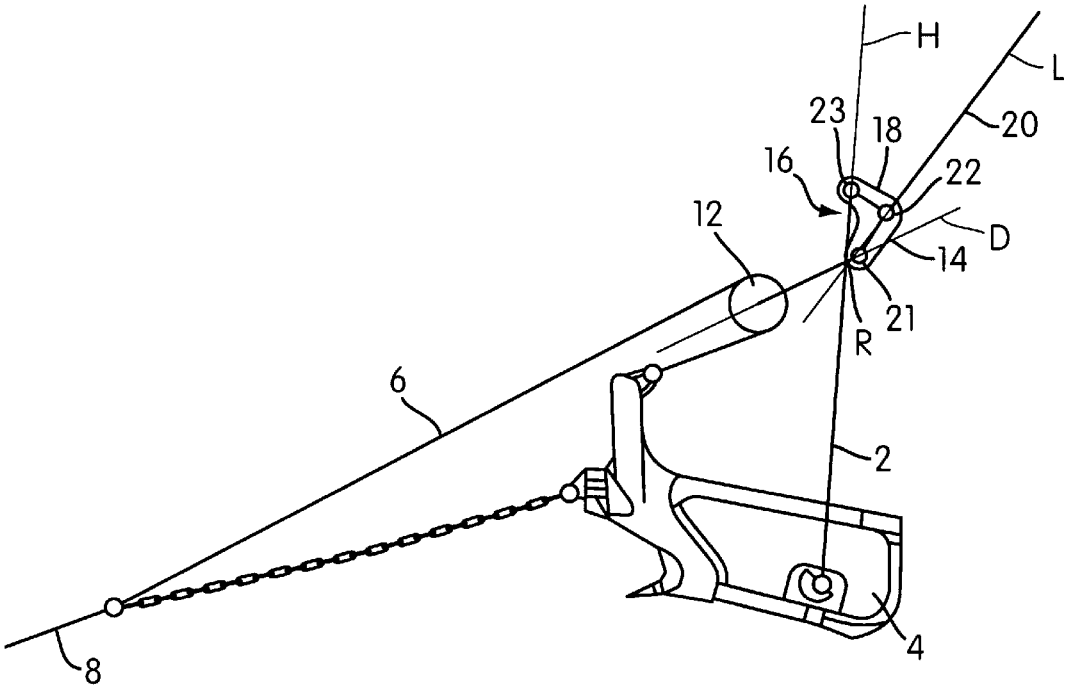
FIG. 9 is identical to FIG. 4B and includes reference vectors and an intersecting reference point.

The lines of force of vectors X L and D for the arrangement of FIG. 4B are shown in FIG. 9. The intersection of these lines is labeled reference point R In the tightline condition in rlation to FIG. 9, it can be seen that compensator 16 has rotated so that sheave 12 has moved forward of reference point R in order to minimize the extent the bucket front is raised.

Figure 5A:
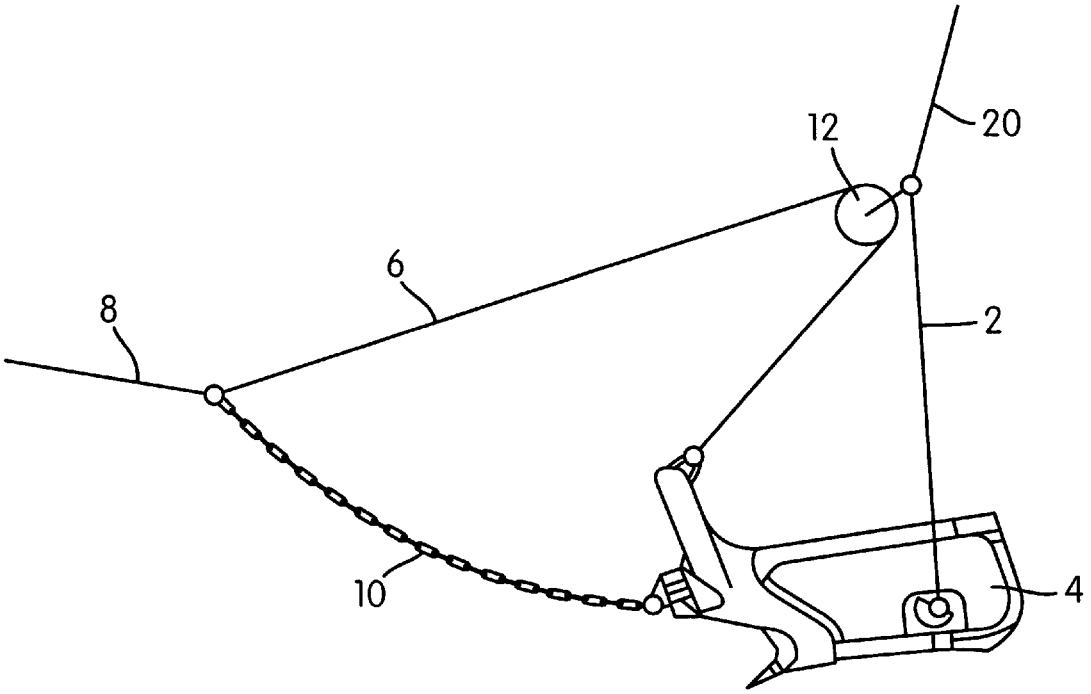
FIG. 5A PRIOR ART
FIG. 5A is a schematic elevational view of a prior art dragline bucket assembly in an operating position deep in a pit and under the distal end of the boom.
Figure 5B:
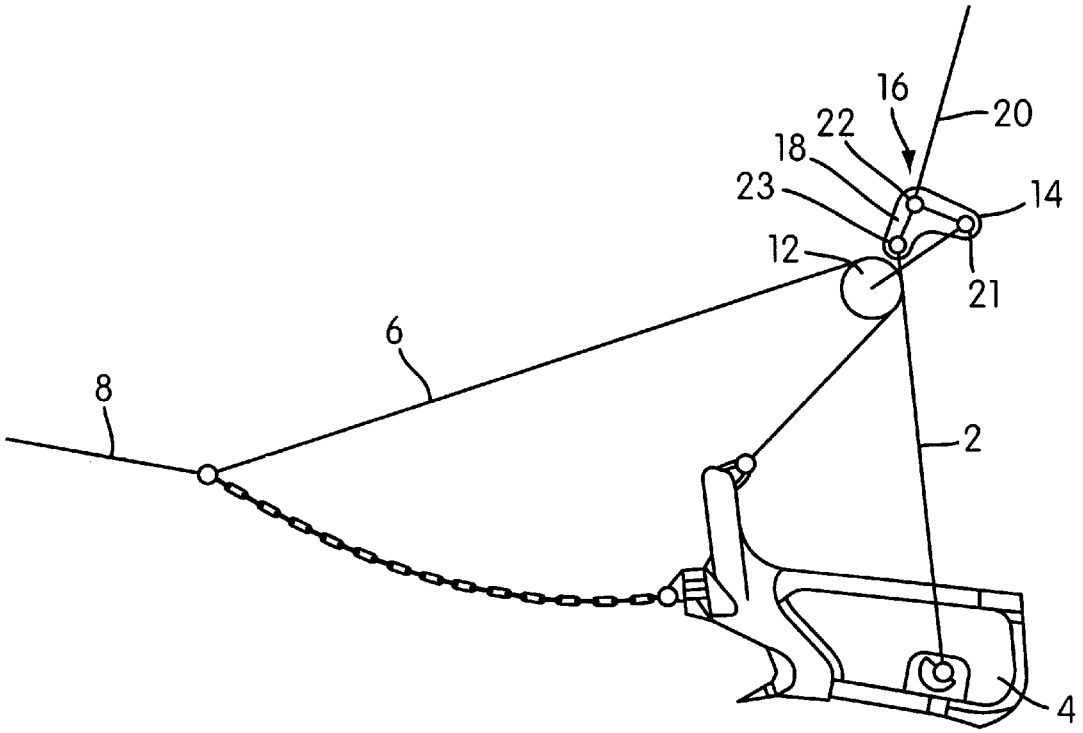
FIG. 5B is a schematic elevational view of a dragline bucket assembly with a compensator in accordance with the present invention in an operating position deep in a pit and under the distal end of the boom.

FIGS. 5A and 5B depict an operating condition known as a slack condition, that is, for example, a condition in which the bucket is deep in the digging pit and beneath the distal end of the boom. FIG. 5A depicts this condition without the compensator of the present invention. At this point in the operation, the forward portion of the dump line 6 is at a smaller angle to the drag line 8 (i.e., the dump line has moved away from a nearly aligned condition with drag line 8) so as to assume a smaller share of the tension in drag line 8. Consequently, the tension in dump line 6 is much less than in the tightline condition. As a result, in this example, bucket 4 tips forward and has a negative (or forward canting) carrying attitude such that some of the contents of bucket 4 could spill out its forward edge.

FIG. 5B depicts the same slack condition in a hoisting assembly which includes a compensator in accordance with the present invention. In this case, the tension in dump line 6 has typically decreased relative to the tension in hoist lines 2. Accordingly, the compensator rotates about fulcrum 22 so that hoist lines 2 are lowered and sheave 56 is shifted rearward. The lowering of the rear of the bucket via hoist lines 2 and the shifting of the sheave rearward to raise the front of the bucket largely offsets the forward tipping caused by a lessening of tension in dump line 6. The desired attitude of the bucket is therefore substantially maintained.

Figure 10:
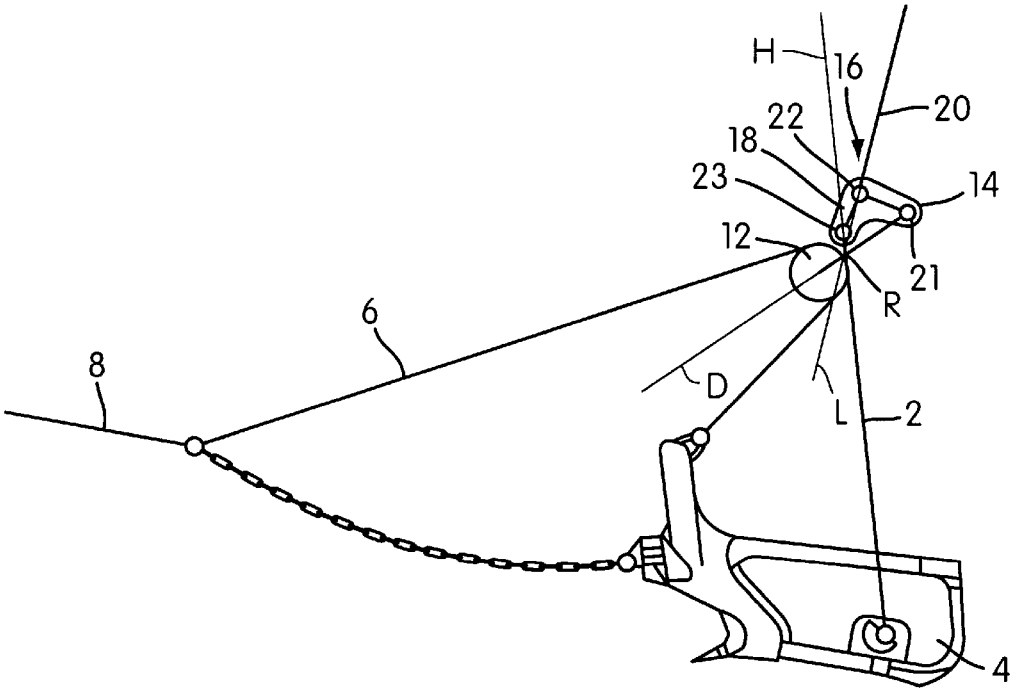
FIG. 10 is identical to FIG. 5B and includes reference vectors and an intersecting reference point.

The lines of force of vectors H, L and D for the arrangement of FIG. 5B are shown in FIG. 10. The intersection of these lines is labeled reference point R. In the slack condition of FIG. 10, it can be seen that compensator 16 has rotated so that sheave 12 has moved rearward, in this instance, toward reference point R in order to minimize the extent the bucket front is lowered.

Figure 6:
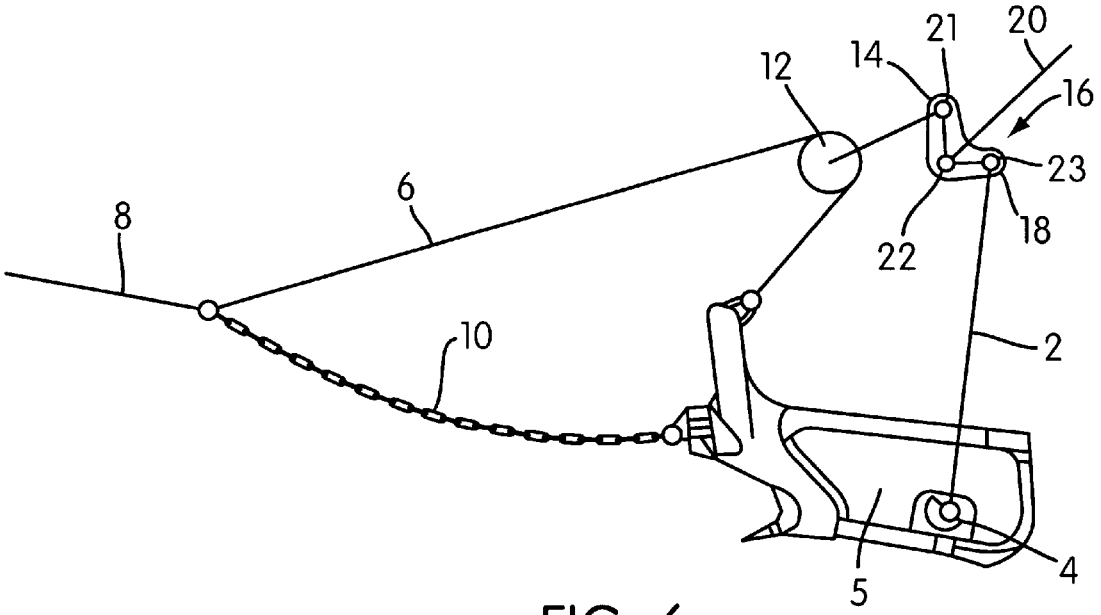
FIG. 6 is a schematic elevational view of an alternative dragline bucket assembly.

As an alternative construction, the compensator 16 can be reversed such that the angle between arms 14 and 16 encompasses the lift line(s) 20 (FIG. 6). The compensator in this embodiment operates in the same manner as the compensator of the embodiment in FIG. 1. In particular, as the tension in dump line 6 increases relative to the tension in hoist lines 2 (e.g., in a tightline condition), compensator 16 turns about fulcrum 22 so as to lift hoist lines 2 and shift sheave 56 forward. Also, as the tension in dump line 6 decreases relative to the tension in hoist lines 2, compensator 16 turns about fulcrum 22 in an opposite direction to lower hoist lines 2 and shift sheave 56 rearward. As discussed above, these adjustments maintain the bucket in a substantially constant attitude.

Figure 7:
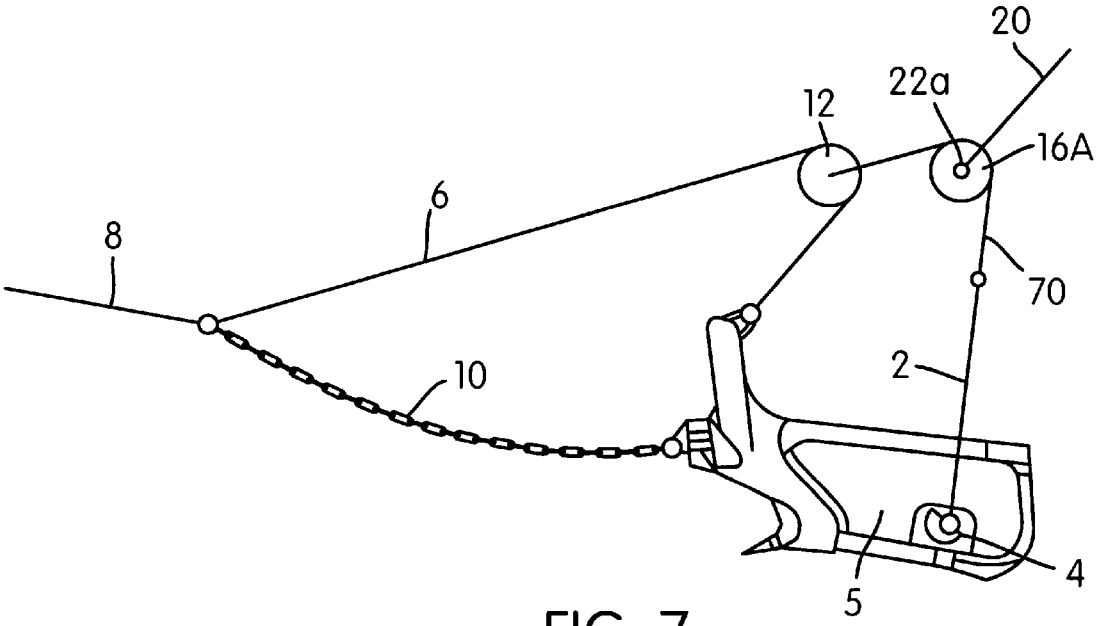
FIG. 7 is a schematic elevational view of an alternative dragline bucket assembly.

In another alternative construction, compensator 16*a* is a cam member (FIG. 7). More specifically, compensator 16*a* has an ovoid or generally circular configuration which connected to lift line(s) 20 at a connector 22*a* offset from the center of the compensator. Connector 22*a* forms a transverse axis of rotation about which the compensator turns. Compensator 16*a* is operably coupled to dump line 6 (via dump block 12) and hoist lines 2 by a coupling line 70. Coupling line 70 is attached at one end to the housing or central pin of dump block 12 and at its other end to hoist lines 2. A medial portion of coupling line 70 wraps about the outer circumferential edge of compensator 16*a*. The compensator is preferably provided with an outer groove to retain the coupling line.

In operation, as the tension of the dump line increases relative to the tension in hoist lines 2, sheave 56 shifts forward to thereby lift hoist lines 2 due to their joining by coupling line 70. Coupling line 70 causes the compensator 16*a* to turn about fulcrum 22*a*. The off-center position of the fulcrum enables the assembly to reach equilibrium with only limited shifting of the coupling line. Similarly, as the tension in dump line 6 decreases relative to the tension in hoist lines 2, sheave 56 shifts rearward and lowers hoist lines 2 via coupling line 70. Again, the cam construction of the compensator permits equilibrium to be reached with only limited shifting (i.e., to offset the lowering of the front of the bucket due to lessening of the tension in the dump line).

In light of the foregoing disclosure of the invention and description of certain preferred embodiments, those who are skilled in this area of technology will readily understand that various modifications and adaptations can be made without departing from the true scope and spirit of the invention. All such modifications and adaptations are intended to be covered by the following claims.

We claim:

1. A dragline bucket hoisting assembly comprising:

a dragline bucket having a front end and a rear end;

at least one lift line extending from a boom;

hoist lines extending from the dragline bucket;

at least one dump line attached to a drag line and the dragline bucket, and at least one compensator operably coupled to said lift, hoist, and dump lines, said lift line being connected to said compensator by a connector which defines a fulcrum, said lift, hoist, and dump lines being arranged such that an increase in tension in said dump line relative to the tension in said hoist lines causes said compensator to rotate about the fulcrum so as to lower the front end of the bucket and a decrease in tension in said dump line relative to the tension in said hoist lines causes said compensator to rotate about the fulcrum so as to raise the front end of the bucket to stabilize said bucket during loaded carry.

2. A hoisting assembly in accordance with claim 1 further comprising a sheave supporting a medial portion of the dump line and being coupled to said compensator.

3. A hoisting assembly in accordance with claim 2 in which said fulcrum is at a first connection point, said sheave is coupled to said compensator at a second connection point, and said hoist lines are connected to said compensator at a third connection point, wherein said connection points are arranged in a non-linear relationship.

4. A hoisting assembly in accordance with claim 3 in which an imaginary line extending between said first and second connection points is set at a significant angle to an imaginary line extending between said first and third connection point.

5. A hoisting assembly in accordance with claim 4 in which said angle is about ninety degrees.

6. A hoisting assembly in accordance with claim 3 in which said compensator includes a pair of angularly oriented legs joined at a common end, wherein said second connection point is proximate an end of one of said legs, said third connection point is proximate an end of the other of said legs, and said first connection point is at the common end of said legs.

7. A hoisting assembly in accordance with claim 6 in which said legs are set at an angle of about ninety degrees to each other.

8. A hoisting assembly in accordance with claim 3 in which said second and third connection points are oriented such that an increase in tension in said dump line relative to the tension in said hoist lines causes said compensator to rotate about the fulcrum so as to lift said hoist lines and shift said sheave forward.

9. A hoisting assembly in accordance with claim 2 in which said sheave and said hoist lines are connected together by a coupling line, and said compensator has a generally arcuate exterior surface which supports a medial portion of said coupling line.

10. A hoisting assembly in accordance with claim 9 in which said compensator is generally circular and said fulcrum in located off-center of said compensator.

11. A compensator for stabilizing the attitude of a dragline bucket comprising a rigid member, first connection means for coupling at least one lift line extending from a boom to said rigid member, second connection member for coupling a sheave supporting a dump line to said rigid member, said third connection means for coupling hoist lines extending from a bucket to said rigid member, said second and third connection means being arranged so as to turn about said first connection means due to variations in relative tension between the dump line and the hoist lines so that an increase in tension in said dump line relative to the tension in said hoist lines causes rotation about said first connection means to lift said hoist lines, and a decrease in tension in said dump line relative to the tension in said hoist lines causes rotation about said first connection means to lower said hoist lines to maintain a stable bucket attitude during loaded carry.

12. A compensator in accordance with claim 11 in which said rigid member includes a pair of angularly oriented legs which are joined at a common end, and wherein said first connection means is located at said common end, said second connection means is located proximate an end of one of said legs, and said third connection means is located proximate an end of the other of said legs.

13. A compensator in accordance with claim 12 in which said legs are set at an angle of about ninety degrees to each other.

14. A compensator for stabilizing the attitude of a dragline bucket comprising a rigid pulley having means for supporting a coupling line connected to hoist lines extending up from the bucket and a sheave supporting a dump line, and connection means for connecting at least one lift line to said pulley at an off-center location, said connection means defining a transverse axis of rotation about which said pulley turns to move said coupling line due to variations in the relative tension between the dump line and the hoist lines.

15. A compensator in accordance with claim 14 in which said means supporting said coupling line is an outer circumferential groove.

16. A method of operating a dragline bucket comprising:

providing at least one lift line extending from a boom, at least one dump line connected to a drag line and a front end of the bucket, a sheave to support a medial portion of each dump line, and hoist lines connected to side walls of the bucket;

increasing the tension in the dump line relative to the tension in said hoist lines; and shifting the sheave forward and lifting the hoist lines relative to the lift line as the tension is increased in the dump line relative to the tension in the hoist lines to maintain a generally constant attitude of the bucket.

17. A method in accordance with claim 16 further comprising decreasing the tension in the dump line relative to the hoist lines, and shifting the sheave rearward and lowering the hoist lines relative to the lift line as the tension is decreased in the dump line relative to the tension in the hoist lines to maintain a generally constant attitude in the bucket.

18. A method in accordance with claim 17 further comprising providing a compensator to which said hoist, lift and dump lines are operably coupled, wherein said shifting of said sheave and said lifting and lowering of said hoist lines are caused by rotation of said compensator about the coupling of the lift line to the compensator.

19. A dragline bucket hoisting assembly comprising:

at least one lift line extending from a boom;

hoist lines extending from a dragline bucket;

at least one dump line attached to a drag line and the dragline bucket;

at least one compensator, having a generally arcuate exterior surface, operably coupled to said lift, hoist, and dump lines, said lift line being connected to said compensator by a connector which defines a fulcrum about which said compensator turns due to variations in relative tension between said dump line and said hoist lines;

a sheave supporting a medial portion of the dump line and being coupled to said compensator, said sheave and said hoist lines connected together by a coupling line, and said exterior surface of said compensator supporting a medial portion of said coupling line.

20. A hoisting assembly for a dragline bucket having a forward end and a rearward end, said assembly comprising:

at least one lift line adapted to extend from a boom;

hoist lines adapted to extend from a dragline bucket;

at least one dump line extending around a sheave rotatable about an axis and supporting a medial portion of the dump line, one portion of the dump line attached to a drag line and another portion attached to a front end of the dragline bucket;

a compensator attached to said lift line by a connector defining a fulcrum, said compensator operably coupling said lift, hoist and dump lines, wherein vectors representing lines of force of said lift line, said hoist line and a resultant of the dump line portions through said sheave axis intersect at a reference point, so that when tension on the dump line is high relative to tension in the hoist lines said compensator rotates about the fulcrum to cause said sheave to move forward with respect to the reference point, and when tension on the dump line is low relative to tension in the hoist lines said compensator rotates about the fulcrum to cause said sheave to move rearward with respect to the reference point whereby the attitude of the bucket is maintained generally stable during loaded carry.

21. The hoisting assembly of claim 20, wherein forward movement of said sheave with respect to the reference point lowers the forward end of the bucket with respect to said reference point to maintain a stable attitude of the bucket.

22. The hoisting assembly of claim 20, wherein rearward movement of said sheave with respect to the reference point raises the forward end of the bucket with respect to said reference point to maintain a stable attitude of the bucket.

23. The hoisting assembly of claim 20, wherein forward movement of said sheave with respect to the reference point corresponds to the rearward end of the bucket being raised with respect to said reference point to maintain a stable attitude of the bucket.

24. The hoisting assembly of claim 20, wherein rearward movement of said sheave with respect to the reference point corresponds to the rearward end of the bucket being lowered with respect to said reference point to maintain a stable attitude of the bucket.

25. A dragline bucket hoisting assembly comprising:

a dragline bucket having a front end and a rear end;

at least one lift line adapted to extend from a boom;

hoist lines extending from the dragline bucket and connected to the bucket at a connection point;

at least one dump line extending around a sheave rotatable about an axis and having one portion attached to a drag line and another portion attached to the dragline bucket; and a compensator attached to said lift line by a connector defining a fulcrum, said compensator operably coupling said lift, hoist and dump lines, wherein vectors representing lines of force of said lift line, said hoist line and a resultant of the dump line portions through said sheave axis intersect at a reference point, said hoisting assembly defining an effective dump line length comprising a sum of a distance between said reference point and the drag line attachment and a distance between said reference point and a front arch of the bucket, so that when tension on the dump line is high relative to tension in the hoist lines said compensator rotates about the fulcrum to lengthen said effective dump line length, and when on the dump line is low relative to tension in the hoist lines said compensator rotates about the fulcrum to shorten said effective dump line length to maintain a generally stable attitude of the bucket during loaded carry.

26. The hoisting assembly of claim 25, wherein lengthening said effective dump line length lowers the front end of the bucket with respect to said reference point to maintain a stable attitude of the bucket.

27. The hoisting assembly of claim 25, wherein shortening said effective dump line length raises the front end of the bucket with respect to said reference point to maintain a stable attitude of the bucket.

28. The hoisting assembly of claim 25, wherein lengthening said effective dump line length corresponds to the rear end of the bucket being raised with respect to said reference point to maintain a stable attitude of the bucket.

29. The hoisting assembly of claim 25, wherein shortening said effective dump line length corresponds to the rear end of the bucket being lowered with respect to said reference point to maintain a stable attitude of the bucket.

30. A dragline bucket hoisting assembly comprising:

at least one lift line adapted to extend from a boom;

hoist lines extending from a dragline bucket and connected to the bucket at a connection point;

at least one dump line extending around a sheave rotatable about an axis and having one portion attached to a drag line and another end attached to the dragline bucket; and a compensator attached to said lift line by a connector defining a fulcrum, said compensator operably coupling said lift, hoist and dump lines, wherein vectors representing lines of force of said lift line, said hoist line and a resultant of the dump line portions through said sheave axis intersect at a reference point, said hoisting assembly defining an effective hoist line length comprising a distance between said reference point and a connection point of said hoist line on the bucket, so that when tension on the dump line is high relative to tension in the hoist lines said compensator rotates about the fulcrum to shorten said effective hoist line length, and when on the dump line is low relative to tension in the hoist lines said compensator rotates about the fulcrum to lengthen said effective hoist line length to maintain a generally stable attitude of the bucket during loaded carry.

31. The hoisting assembly of claim 30, wherein shortening said effective hoist line length raises a rear end of the bucket with respect to said reference point to maintain a stable bucket attitude.

32. The hoisting assembly of claim 30, wherein lengthening said effective hoist line length lowers a rear end of the bucket with respect to said reference point to maintain a stable bucket attitude.

33. A compensator comprising:

a first means for attaching a lift line adapted to extend from a boom to a bucket;

a second means for attaching a hoist line adapted to extend from a dragline bucket;

a third means for rotatably supporting a sheave about which a dump line extends, one end of the dump line being attached to a drag line and another end of the dump line adapted to be attached to a front end of the bucket; and means for adjusting the relative positions of said first, second and third attaching means due to changing loads in the dump line, wherein, the front end of the dragline bucket is lowered in response to a forward movement of said third attaching means due to an increased load on the dump line, and the front end of the dragline bucket is raised in response to a rearward movement of said third attaching means due to a decreased load on the dump line.

* * * * *